US006648676B1

(12) United States Patent
Lee

(10) Patent No.: US 6,648,676 B1
(45) Date of Patent: Nov. 18, 2003

(54) CABLE END CONNECTOR ASSEMBLY

(75) Inventor: George Lee, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/330,740

(22) Filed: Dec. 24, 2002

(51) Int. Cl.[7] ..... H01R 12/24
(52) U.S. Cl. ..... 439/499
(58) Field of Search ..... 439/492–499, 439/64, 604, 76.1, 77

(56) References Cited

U.S. PATENT DOCUMENTS 3,601,768 A * 8/1971 Lightner ..... 439/459
3,634,806 A * 1/1972 Fergusson ..... 439/497
3,951,492 A * 4/1976 Braund ..... 439/76.1
4,605,276 A * 8/1986 Hasircoglu ..... 439/465
4,781,620 A * 11/1988 Tengler et al. ..... 439/497
5,518,421 A * 5/1996 Davis ..... 439/607
D412,700 S 8/1999 Gardner et al.
5,993,256 A * 11/1999 Shimojyo ..... 439/604
6,129,594 A * 10/2000 Lai ..... 439/701
6,203,335 B1 * 3/2001 Chang ..... 439/79
6,210,204 B1 * 4/2001 Ko et al. ..... 439/404
6,273,753 B1 * 8/2001 Ko ..... 439/579
6,331,122 B1 * 12/2001 Wu ..... 439/567
6,361,372 B1 * 3/2002 Chiang ..... 439/680
6,457,994 B1 * 10/2002 Johnson et al. ..... 439/492
6,494,749 B1 * 12/2002 Chang ..... 439/701

* cited by examiner

*Primary Examiner*—Tho D. Ta
*Assistant Examiner*—Larisa Tsukerman
(74) *Attorney, Agent, or Firm*—Wei Te Chung

(57) ABSTRACT

A cable end connector assembly (100) comprises an insulative housing (2), a plurality of power contacts (31) and signal contacts (32), a spacer device (4), a plurality of wires (5), a cable (6), an over-molding cover (7), a panel (1), and a pair of screws (8). The signal contacts and power contacts are mounted in the housing. The spacer device is inserted into the housing and engages with the signal and power contacts. Each wire has a conductor electrically connecting a corresponding power contact. The cable has a plurality of conductors each electrically connecting a corresponding signal contact. The cover is over-molded with and encloses a rear end of the housing and the wires and the cable. The panel mates with the mating section of the housing, and the screws extend through the housing and the panel.

11 Claims, 6 Drawing Sheets

CABLE END CONNECTOR ASSEMBLY

CROSS-REFERENCE TO RELATED APPLICATION

This patent application is related to a contemporaneously filed application Ser. No. 10/330,236 entitled "CABLE CONNECTOR ASSEMBLY" and invented by the same inventor and assigned to the same assignee as the present application.

BACKGROUND OF THE INVENTION

1. Field of the Invention

The present invention relates to an electrical connector assembly, particularity to a cable end connector including power and signal members for transmitting power and signals, wherein the connector can achieve a good electrical connection with a complementary connector 2. Description of Related Art Serial Advanced Technology Attachment (SATA) is a high speed interface between storage devices (such as hard disks, CD-ROMs, and DVDs) and a mother board. Because of the numerous advantages of Serial ATA, It is developed as a replacement for Parallel ATA and Ultra ATA.

Generally, a conventional electrical cable end according the SATA, the power and the signal cable end are separately assembled to two connectors which are used to respectively mate with complementary connectors on the mother board. Such a connecting operation is laborious and inconvenient. Furthermore, to form two separate connectors on each of the cable end and on the mother board is expensive, which is disadvantage from the point of view of cost. It is desired to provide a new cable end connector connecting the power cable end and signal cable end together for mating with the complementary connector at the same time so that manufacturing and assembling process can be simplified and cost can be reduced.

SUMMARY OF THE INVENTION

An object, therefore, of the present invention is to provide a cable end connector assembly integrally terminating power and signal members for transmitting power and signals to a complementary connector on a mother board.

Another object of the present invention is to provide a cable end connector with an over-molding cover to protect the soldering termination.

In order to achieve the objects set forth, a cable end connector assembly comprises an insulative housing, a plurality of signal and power contacts, a spacer device, a plurality of wires, a cable, an over-molding cover, a panel, and a pair of screws.

The housing has a base, a mating section extends forwardly from the base, the mating section defines a receiving space therein adapted for receiving a mating portion of the complementary connector. The signal contacts and power contacts are mounted in the housing. The spacer device is inserted into the housing and engages with the signal and power contacts. Each wire has a conductor electrically connecting a corresponding power contact. The cable has a plurality of conductors each electrically connecting a corresponding signal contact. The cover is over-molded with and encloses a rear end of the housing and the wires and the cable. A panel mates with the mating section of the housing, and a pair of screws extend through the housing and the panel.

Other objects, advantages and novel features of the invention will become more apparent from the following detailed description when taken in conjunction with the accompanying drawings.

DETAILED DESCRIPTION OF THE INVENTION

Figure 1:
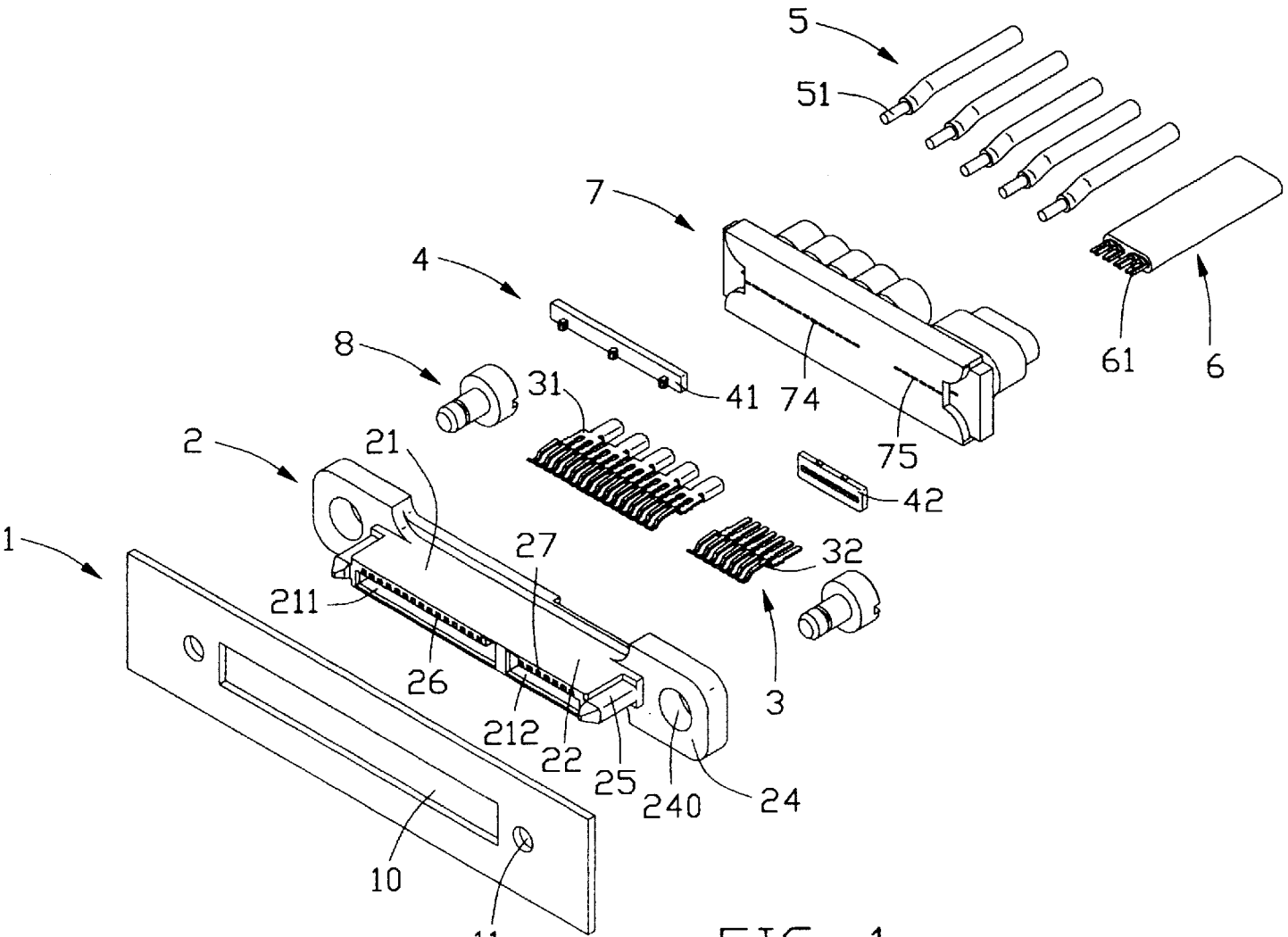
FIG. 1 is an exploded, perspective view of a cable end connector assembly in accordance with the present invention.
Figure 2:
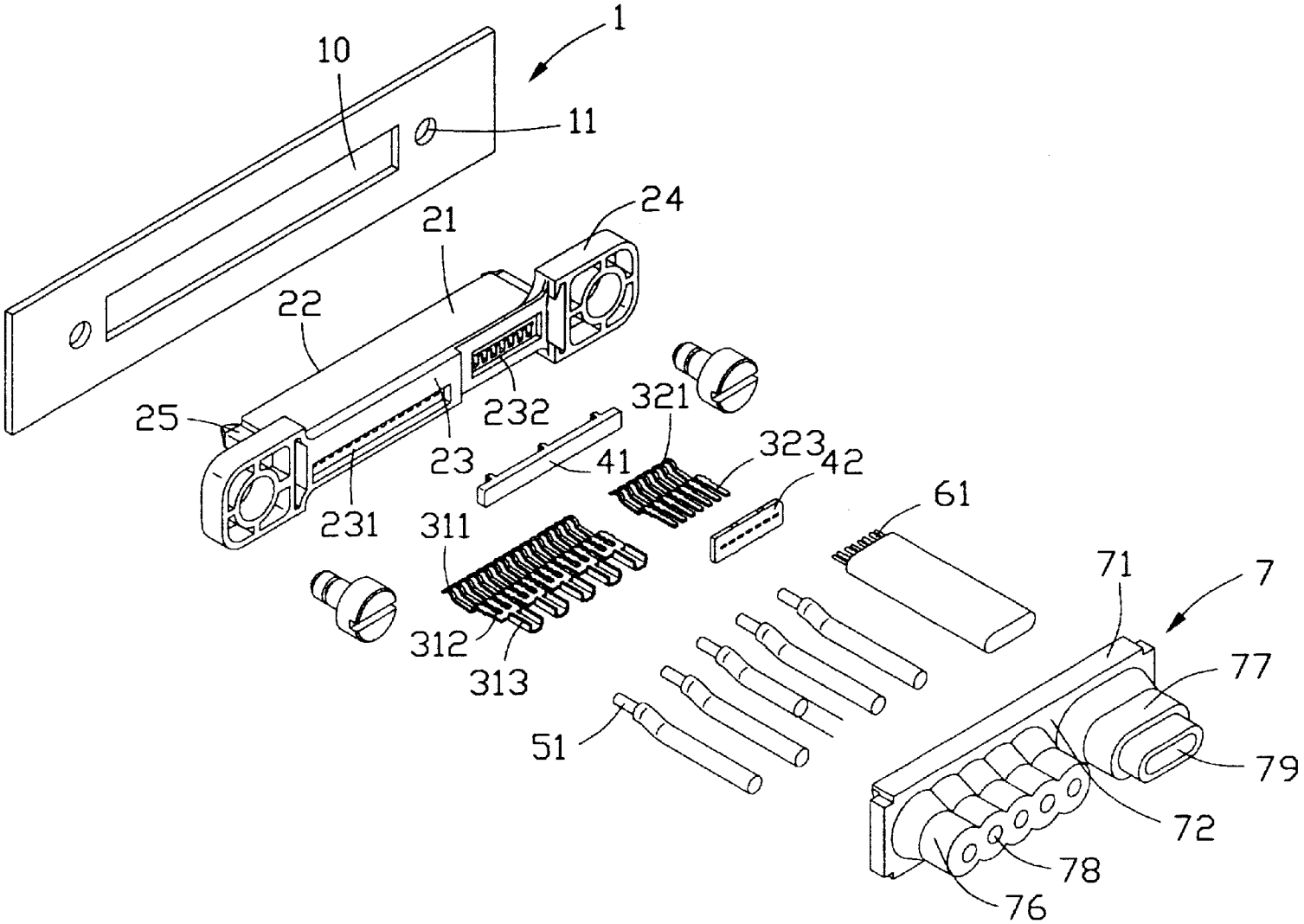
FIG. 2 is a view similar to FIG. 1, but taken from a rear aspect.

Referring to FIG. 1 and FIG. 2, a cable end connector assembly 100 in accordance with the present invention is a typical standard Serial ATA connectors. However, in alternative embodiments, the electrical connectors could be provided as other than Serial ATA electrical connectors. The cable end connector 100 comprises a panel 1, an insulative housing 2, a contact insert 3, a spacer device 4, a plurality of wires 5, a cable 6, an over-molding cover 7, and a pair of screws 8. The panel 1 defines a rectangular slot 10 and a pair of holes 11 beside the rectangular slot 10.

Figure 3:
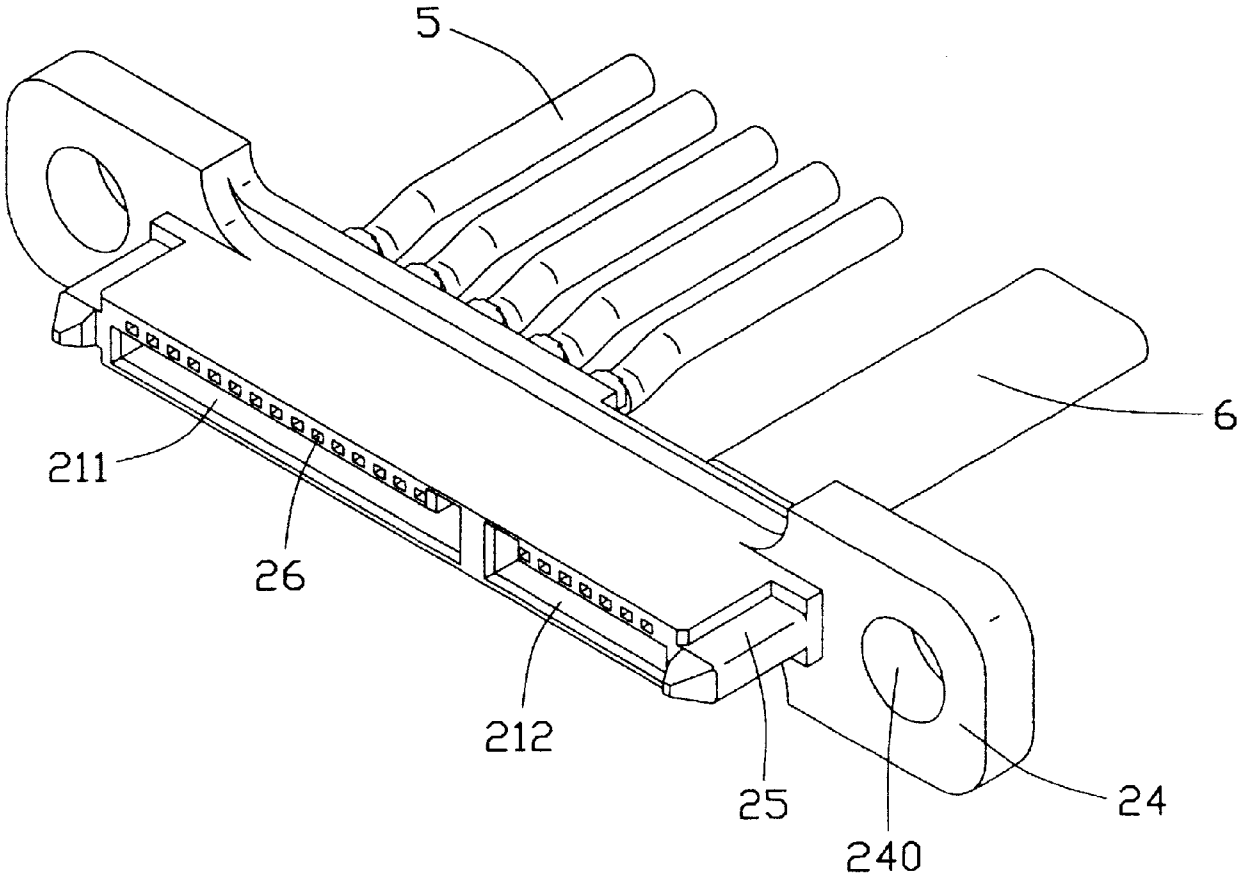
FIG. 3 is an assembled view of the cable end connector assembly with a over-molding cover, a panel and a pair of nuts thereof being removed.
Figure 4:
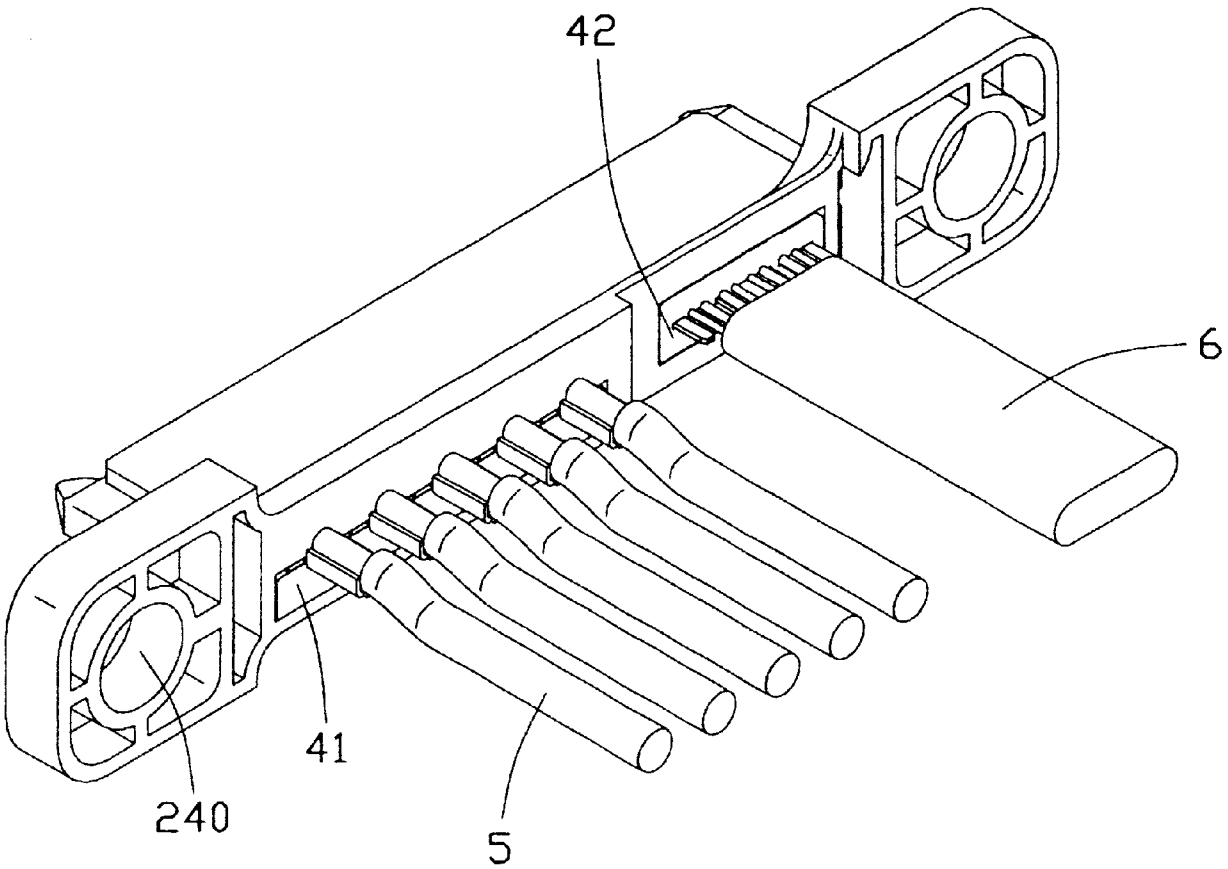
FIG. 4 is a view similar to FIG. 3, but taken from a rear aspect.
Figure 5:
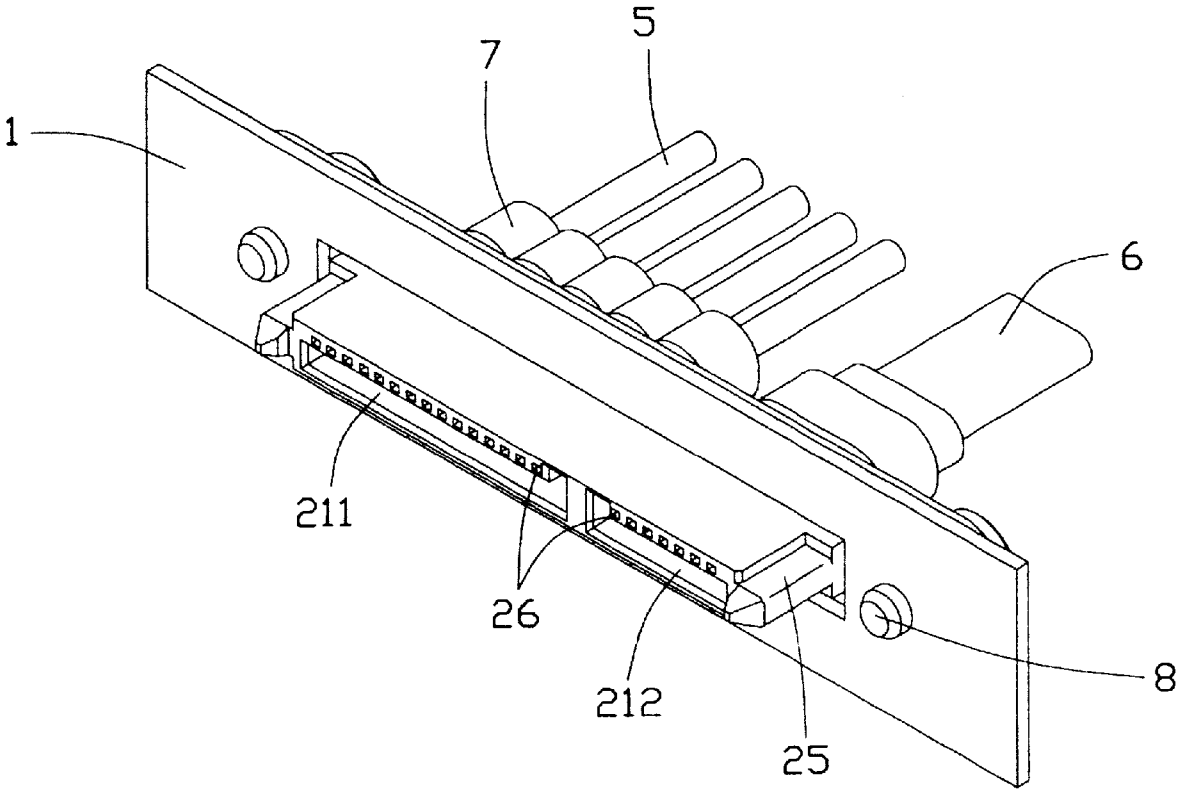
FIG. 5 is a fully assembled view of the cable end connector assembly.
Figure 6:
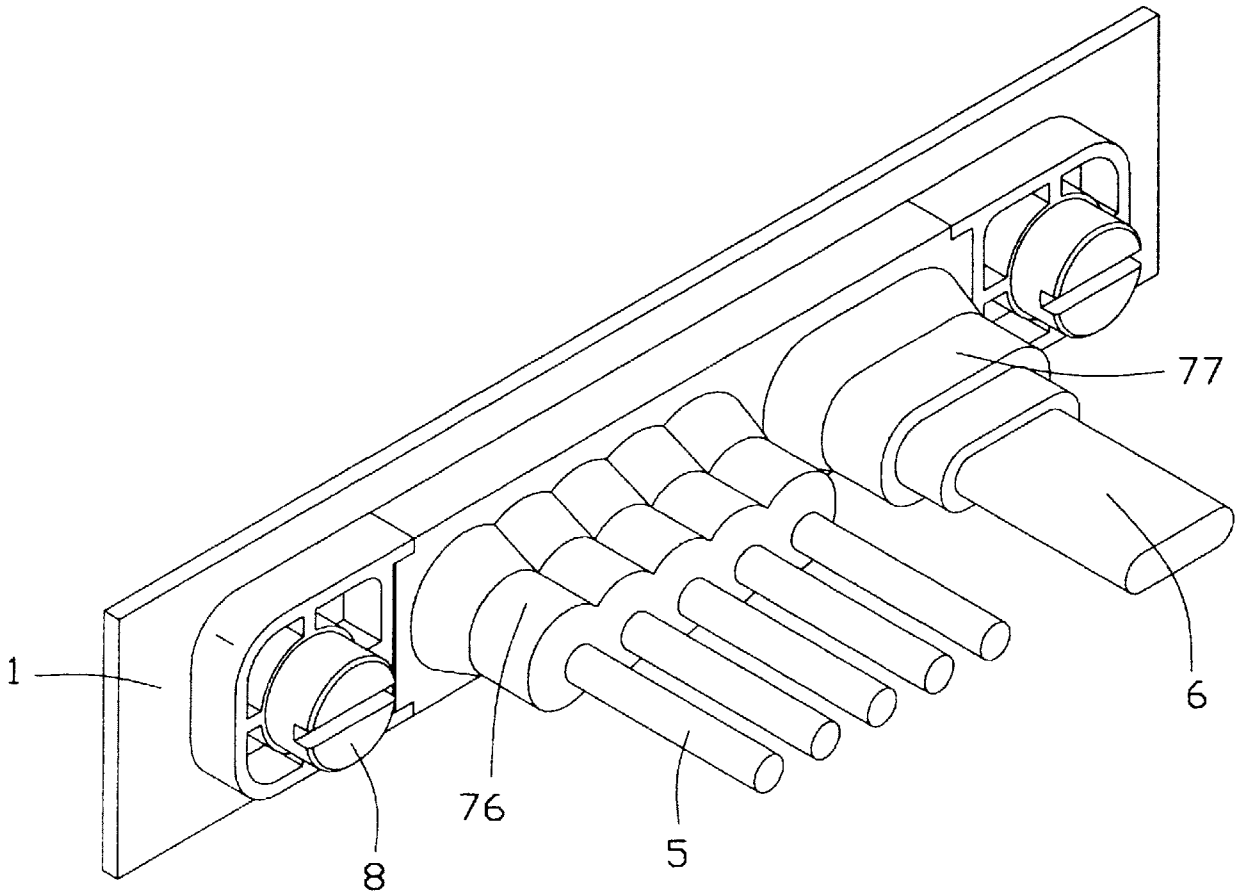
FIG. 6 is a view similar to FIG. 5, but taken from a rear aspect.

Referring to FIGS. 1–3, the insulative housing 2 comprises a rectangular base 21, a mating section 22 extending forwardly from the base 21. The base 21 has a rear portion 23. The base 21 defines two receiving spaces 211, 212 for receiving the mating portions of a complementary connector (not shown). The mating section 22 defines a plurality passageways 26 extending rearwardly through the base 21. The rear portion 23 defines a pair of recesses 231, 232 therein. A pair of flanges 24 formed at the lateral sides of the base 21. Each of the flanges 24 defines a positioning hole 240 therein. The base 21 further forms guides 25 at each of opposite lateral sides thereof for guiding the cable end connector 100 to mate with the complementary connector.

Referring to FIG. 2, the contact insert 3 comprises a plurality power and signal contacts 31, 32 for transmitting power and signals. Each power contact 31 comprises an engaging portion 311 received into a corresponding passageway 26, a connecting portion 312 connecting the engaging portion 311, and a tail portion 313 extending rearwardly from the connecting portion 32. Each signal contact 32 comprises an engaging portion 321, and a tail portion 323 extending rearwardly from the engaging portion 321.

Referring to FIGS. 1, 2, 4 and 5, the spacer device 4 comprises a first spacer 41, and a second spacer 42. The first spacer 41 is inserted into the recess 231 of the insulative housing 2 and located below the connecting portion 312 of the power contacts 31. The tail portions 323 of the signal contacts 32 extend through the second spacer 42. The second spacer 42 engages in the recess 232. The tail portions 313, 323 of power contacts 31 and signal contacts 32 connect the wires 5 and the cable 6, respectively.

The wires 5 comprise a plurality of conductors 51 electrically connecting the tail portions 313 of the power contacts 31. A plurality of outer insulative covers 511 enclose the conductors 51, respectively.

The cable 6 comprises a plurality of conductors 61 extending forwardly beyond a front end thereof and connecting the tail portions 323 of signal contacts 32.

Referring to FIGS. 1, 2, 5 and 6, the cover 7 is over-molded to the housing 2 and the wires 5 and the cable 6. The cover 7 is made of PVC and comprises a rectangular body 71, a rear portion 72 extending rearwardly from the body 71. A plurality of channels 74, 75 are defined in a front portion of the cover 7 and holder portions 76, 77 are formed in a rear portion at the cover 7. The rear portion 72 of the cover 7 defines opening portions 78, 79 therethrough for receiving the front ends of the plurality of wires 5 and the cable 6.

The pair of screws 8 is mounted in the corresponding positioning holes 240 of the flanges 24 and the holes of the panel 1. The screws 8 are used for threadedly fastening the cable end connector 100 with the complementary connector when the two connectors are mated together.

Referring to FIGS. 1, 2, 5 and 6, in assembly, the contact insert 3 is first assembled into the housing 2 along a rear-to-front direction. The engaging portions 311, 321 of the power contacts 31 and signal contacts 32 are received into the passageways 26, respectively. The tail portions 313, 323 are exposed outside the housing 2. The first spacer 41 is inserted into the recess 231 and located below the connecting portions 312 of power contacts 31. The second spacer 42 is inserted into the recess 232 with the tail portions 323 of the signal contacts 32 fitting through the second spacer 42. The spacers 41, 42 prevent molten PVC from flowing into the mating portion 22 via the recesses 231, 232 when the cover 7 is over-molded to the housing 2 and the wires 5 and the cable 6.

The conductors 51, 61 of the wires 5 and the cable 6 are soldered to the corresponding tail portions 313, 323 of the contacts 31, 32. The cover 7 is then over-mold to the rear portion 23 of the housing 2 with the front end of the wires 5 and the cable 6 received in the opening portions 78, 79, respectively. The panel 1 engages with the housing 2; the mating section 22 of the housing 2 is received in the rectangular slot 10 of panel 1. The pair of holes 11 corresponds to the positioning holes 240 of the flanges 24. The screws 8 extend through the positioning holes 240 of the flanges 24 and the holes 11 of the panel 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly comprising: an insulative housing having a base, a mating section extending forwardly from the base, the mating section defining a receiving space therein adapted for receiving a mating portion of the complementary connector: a plurality of signal contacts and power contacts mounted in the housing; a spacer device inserted into the housing engaging with the signal and power contacts; a plurality of wires, each wire having a conductor electrically connecting a corresponding power contact; a cable having a plurality of conductors each electrically connecting a corresponding signal contact; a cover over-molded with and enclosing a rear end of the housing and the wires and the cable; a panel mating with the mating section of the housing; and a pair of screws extending through the housing and the panel; wherein the spacer device comprises a first spacer located below the power contacts, and a second spacer fitting with the signal contacts.

2. The cable end connector assembly as claimed in claim 1, wherein the housing further defines a plurality of passageways therethrough for receiving the contacts therein.

3. The cable end connector as claimed in claim 1, wherein the housing further defines two recesses receiving the spacers.

4. The cable end connector as claimed in claim 1, wherein the housing further forms a pair of flanges at opposite lateral sides of the housing, each flange defining a positioning hole therein.

5. The cable end connector as claimed in claim 1, wherein the housing further comprises a pair of guides at opposite lateral sides thereof for guiding the cable end connector to mate with a complementary connector.

6. The cable end connector as claimed in claim 1, wherein each wire comprises an outer insulative cover enclosing a corresponding conductor.

7. The cable end connector as claimed in claim 1, wherein the over-molding cover comprises opening portions for receiving the front ends of the wires and the cable.

8. The cable end connector as claimed in claim 1, wherein the panel defines a slot receiving the mating portion of the housing and further defines a pair of holes therein.

9. The cable end connector as claimed in claim 8, wherein the pair of screws engaging with and extending through the positioning holes of flanges and the holes of the panel.

10. A cable connector assembly comprising:

an unitary insulative housing defining a lengthwise direction and a vertical direction perpendicular to each other, said housing including two ports each with a plurality of contacts therein, each of said contacts including a straight rearwardly extending tail;

two vertical spacers corresponding to said two ports and mounted on a rear face of the housing to seal said rear face except with a plurality of slits through which the tails extend rearwardly;

a plurality of discrete wires mechanically and electrically connected to the corresponding tails;

a unitary cover over-molded on the tails and front portions of the wires; and a unitary panel secured to a front portion of the housing with openings through which said two ports extend forwardly; wherein both said cover and said panel define dimensions along said lengthwise and vertical directions similar to those of said housing.

11. The assembly as claimed in claim 10, wherein said housing and said panel are fastened to each other by screws.

* * * * *